United States Patent [19]

Edwards

[11] 4,223,497

[45] Sep. 23, 1980

[54] COUPLING ASSEMBLY

[75] Inventor: Hugh J. W. Edwards, Menston, England

[73] Assignee: CCL Systems Limited, England

[21] Appl. No.: 919,097

[22] Filed: Jun. 26, 1978

[51] Int. Cl.[2] ..... E04C 3/10

[52] U.S. Cl. ..... 52/230; 403/284

[58] Field of Search ..... 52/230, 726, 223; 403/284, 285, 274

[56] References Cited

U.S. PATENT DOCUMENTS

| | | | |
|---|---|---|---|
| 3,327,380 | 6/1967 | Howlett | 52/230 |
| 3,460,300 | 4/1969 | Howlett | 52/726 |
| 3,551,999 | 1/1971 | Gutmann | 403/274 |
| 3,659,321 | 5/1972 | Laurent | 52/230 |
| 3,729,218 | 4/1973 | Gutmann | 403/274 |
| 4,065,221 | 12/1977 | Cawthorne | 403/284 |

FOREIGN PATENT DOCUMENTS

| | | | |
|---|---|---|---|
| 987078 | 4/1976 | Canada | 52/223 L |
| 2360667 | 6/1974 | Fed. Rep. of Germany | 52/230 |
| 2423741 | 11/1975 | Fed. Rep. of Germany | 52/230 |
| 92319 | 10/1959 | Netherlands | 403/284 |
| 430135 | 8/1967 | Switzerland | 52/230 |
| 540714 | 10/1941 | United Kingdom | 52/230 |

*Primary Examiner*—Price C. Faw, Jr.
*Assistant Examiner*—Henry E. Raduazo
*Attorney, Agent, or Firm*—Caesar, Rivise, Bernstein & Cohen, Ltd.

[57] ABSTRACT

A method of coupling the strands 2, 5 of adjacent sections of a stressing tendon in a multi-span post-tensioned concrete structure comprises tensioning strands 2 of a first section of the tendon, anchoring the strands 2 in an anchorage member 1 using wedges 3, and then joining the strands 2 of the first section to strands 5 of a second section of the tendon in end-to-end relation by compressing metal sleeves 6 around the strands. The sleeve 6 may have hardened metal inserts 7. The outer strands 5 may be gradually directed inwards by a first collar 9 and a second collar 11 may be provided so as to gradually direct the strands 5 into a duct 10 for the second section of the tendon.

6 Claims, 1 Drawing Figure

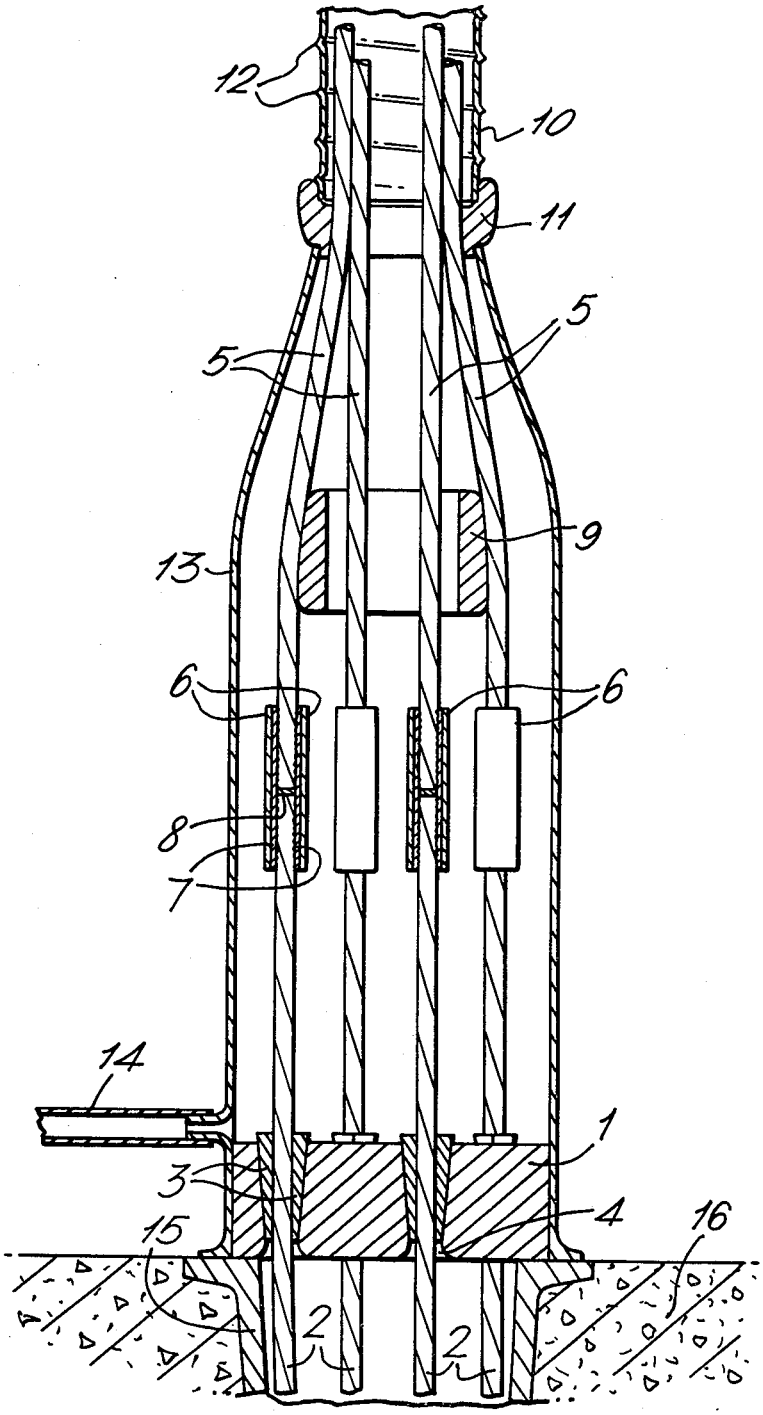
12
10
11
5
5
9
13
6
6
8
7
14
1
3
4
15
16
2
2

COUPLING ASSEMBLY

This invention relates to a method of, and coupling assembly for, coupling the wires or strands of adjacent sections of a stressing tendon in a multi-span post-tensioned concrete structure.

It is an object of the invention to provide a method of coupling the wires or strands of adjacent sections of a stressing tendon, in which the volume of the coupling assembly is as small as possible so that the strength of the concrete structure is not significantly reduced in the region of the coupling assembly.

According to the invention, a method of coupling wires or strands of adjacent sections of a stressing tendon comprises, tensioning the wires or strands of a first section of the tendon, anchoring end portions of the wires or strands of the first section in an anchorage member, positioning within a metal sleeve the end of a wire or strand of the first section adjacent an end of a wire or strand of a second section of the tendon and compressing the sleeve so as to grip both wires or strands.

The sleeve is preferably formed of a cold-forming or swaging steel and may be provided with hardened metal inserts having serrated or threaded inner and outer surfaces to grip the sleeve and the wire or strand.

Preferably the end portions of the wires or strands of the first section of the tendon are cut so as to all extend for the same distance beyond the anchorage member towards the second section.

A first collar is preferably located among the wires or strands of the second section of the tendon, the collar having an outer surface which is curved longitudinally so as to gradually direct the outermost wires or strands inwardly.

Preferably a second collar is located around the wires or strands of the second section adjacent an end of a duct for the tendon, the inner surface of the collar being curved longitudinally so as to gradually direct the outermost of the wires or strands into the duct.

The invention also includes a coupling assembly for the wires or strands of adjacent sections of a stressing tendon, comprising an end portion of a wire or strand of a first section of the tendon being anchored in an anchorage member, the end portion being joined to a wire or strand of a second section of the tendon in end-to-end relation by a metal sleeve compressed around the wires or strands.

The invention may be further illustrated by way of example with reference to the accompanying diagrammatic drawing which is a longitudinal-sectional view of a coupling assembly according to the invention.

The assembly comprises an anchor plate 1 in which strands 2 of a first section of a tendon are anchored by split conical wedges 3 received in frusto-conical bores 4 through the plate 1. The strands 2 are symmetrically arranged in the plate 1, some of the strands being omitted from the drawing for clarity. The strands 2 all extend for about the same distance beyond the plate 1 away from the concrete.

The strands 2 are coupled to strands 5 of a second section of the tendon by sleeves 6 which are compressed on to the adjacent end portions of the strands 2, 5. The sleeves 6 are formed of mild steel and each sleeve has a hardened steel insert 7 in the annular space between the sleeve and the strands 2, 5. The adjacent ends of the strands 2, 5 are separated by a spacing disc or ring 8.

The inserts are screw-threaded internally so as to bite into the adjacent strands 2, 5, and are serrated or knurled externally so as to bite into the inner surface of the sleeve 6, which ensures a strong coupling between the adjacent strands.

A first collar 9 is located among the strands 5 and the outer surface of the collar 9 is curved longitudinally so as to gradually direct the outermost strands 5 inwardly towards an end of tendon duct 10. A second collar 11 is located around the strands 5 adjacent the end of the tendon duct 10 and the inner surface of the collar 11 is curved longitudinally so as to gradually direct the outermost of the strands 5 into the duct 10. The duct 10 is of a conventional type and is formed with a wall shaped to define a screw thread 12.

A partially tapered cylindrical cover 13 is located around the strands 2, 5 and the anchorage plate 1 and engages the second collar 11 so as to form a sealed cover for the strands 2, 5. A pipe 14 is connected to an outlet adjacent the plate 1 so as to allow air to be expelled from within the cover 13 during grouting of the duct 10 and cover. The cover 13 may be formed of a strong lightweight material such as sheet metal or a glass-fibre reinforced plastics material.

In building a multi-span post-tensioned concrete structure, the first span of the structure terminates with a conventional tube unit 15 which is cast into the concrete 16. The unit 15 is connected by conventional ducting (not shown) to a similar tube unit cast into the concrete at the opposite end of the first span or to another coupling assembly such as that shown in the drawing.

The strands 2 are then threaded through the ducting of the first span and through the bores 4 of the anchorage plate 1 which is located on the tube unit 12. The opposite ends of the strands 2 are anchored at the opposite end of the first span of the structure. A stressing jack, according to our British Pat. No. 1 375 203 for example, is then used to tension the strands and anchor them in the bores 4 using the wedges 3. The strands 2 may be tensioned individually or collectively, depending on the type of jack used.

The strands 5 of the second section of the tendon are then threaded through the tendon duct 10 of the second span and the ends of the strands 5 are passed through the second collar 11 and through the narrow end of the cover 13. The cover 13 is together with the collar 11 moved clear of the ends of the strands, which may conveniently be achieved by screwing the duct 10 onto a portion of the duct of narrower diameter which is cooperatively screw-threaded with the screw thread 12 of the portion of the duct 10 adjacent the coupling assembly. When the cover 13 is moved clear of the strands sufficiently to allow access to them, the first collar 9 is threaded over the innermost strands 5 and is drawn clear of their ends.

The portion of the strands 2 of the first span which protrude from the plate 1 are then all cut to the same length. The length chosen depends upon the type of strand used and the number of strands because the length has to be sufficient to allow the strands to be bent to allow free access to their ends.

Sleeves 6 may be prepared as follows; a short portion, say 5 mm, of a first end of a plain tube of cold-working steel is placed between the dies of a swaging press and compressed so as to give a chamfer of about 7° and a corresponding internal constriction. A first insert 7 is inserted into the tube with the end of the insert contacting the constriction at the end of the tube. A spacing ring 8, in the form of a steel washer having a diameter not greater than that of the wires or strands to be joined, is then placed in the sleeve, followed by a second insert 7. Finally, the second end of the sleeve is compressed in the same way as the first end so as to retain the inserts 7 and the spacing ring 8 within the sleeve.

The strands 2, 5, are coupled together by placing the end of one strand 2 of the first section in the sleeve 6 such that the end contacts the spacing ring 8, and placing the end of a strand 5 of the second section in the opposite end of the sleeve 6. The sleeve is then compressed on to the ends of the strands 2, 5 using a press capable of compressing sleeves on to strands arranged in close proximity to each other. All the strands 2, 5 are coupled in a similar manner and the first collar 9 is then moved along the strands 5 to a position corresponding to the start of the tapered portion of the cover 13 when the cover is in its final position. The cover 13 may then be moved, together with the second collar 11, to a final position surrounding the anchorage plate 1, as shown in the drawing.

The concrete of the second span may then be cast around the coupling assembly in the usual way and the second tendon tensioned and anchored at the other end. The duct may then be grouted with a cement grout in the usual way to prevent corrosion.

The coupling method and assembly of the invention permit adjacent sections of a tendon to be coupled with a considerable reduction in the volume of the assembly over known coupling assemblies. Also, since the components required are fewer, the cost of the assembly is reduced.

The sleeves may be arranged in close proximity which means that the strands of the first section may all be cut to the same length thus making the assembly simple and fast to use. The close proximity of the strands in the assembly reduces the deviation of the individual strands and allows the assembly to be reduced in length as well as diameter. There is almost no limit to the number of strands which may be coupled using the assembly and method of the invention.

A further advantage of the present invention is that since the tensile forces are transmitted along the individual strands the anchorage plate can be made thinner, and hence cheaper, loading of the second tendon section tending to reduce the load on the anchorage plate due to the first section.

The deviation collars prevent sharp changes in the path of the wires or strands which would reduce their axial tensile strength and allow a further reduction in the length of the coupling assembly.

What is claimed as the invention is:

1. A method of connecting strands of adjacent first and second sections of a stressing tendon, each of said sections including plural parallelly disposed strands, each of said strands having an end portion terminating in a free end, comprising passing portions of the strands of said first section parallelly through anchoring means, locking said portions in said anchoring means with the end portions of said strands being spaced apart and disposed parallel to one another, disposing end portions of the strands of said second section parallel to one another so that the free ends thereof are coaxially with the free ends of the strands of the first section and are located closely adjacent thereto, directing portions of strands of the second section contiguous with the end portions thereof inwardly toward one another so that the spacing therebetween is less than the spacing between strands at the end portion of the first section, disposing the closely adjacent, axially aligned free ends of the strands of the first and second sections within respective sleeves and compressing the sleeves so as to grip the strand ends.

2. The method of claim 1, additionally comprising locating a first collar among the strands of the second section, said collar having a longitudinally curved outer surface engaging the outermost strands of said second section at portions thereof contiguous with the end portions thereof to gradually direct outermost strands inwardly.

3. The method of claim 2 additionally comprising locating a second collar around the strands of the second section contiguous with the end portions thereof, the inner surface of said second collar being curved longitudinally so as to gradually direct the outermost of the strands into a duct for the tendon.

4. A coupling assembly for strands of adjacent first and second sections of a stressing tendon, each of said sections including plural parallely disposed strands, each of said strands having and end portion terminating in a free end, said assembly comprising anchoring means, first collar means and second collar means, the end portions of the strands of said first section extending through said anchoring means so that the free ends thereof extend parallel to one another beyond said anchoring means, said anchoring means locking said strands in place, the free ends of the strands of said second section being aligned coaxially with and connected to the free ends of the strands of the first section by respective compressed metal sleeves, said first collar means having a longitudinally curved outer surface and being located among the strands of the second section at the end portions thereof so that the outermost strands of the second section engage said surface, whereupon said surface directs the outermost strands gradually inward so that the spacing between said strands is less than the spacing between strands of the end portion of the first section, said second collar means being located around the outermost strands of said second section adjacent the end portion thereof, said second collar means having a longitudinally curved inner surface for engaging the outermost strands to gradually direct said strands inwardly parallel to the axis of the innermost strands of the second section.

5. The assembly of claim 4 wherein each of said compressed metal sleeve comprises a hardened metal insert.

6. The coupling assembly of claim 5 in which said metal insert has gripping inner and outer surfaces.

* * * * *